US006767278B1

(12) United States Patent
Peterson

(10) Patent No.: US 6,767,278 B1
(45) Date of Patent: Jul. 27, 2004

(54) WINDOW-MOUNTED AIR CONDITIONER INSTALLATION SYSTEM

(76) Inventor: Andrew Peterson, 850 W. 176 St., Apt. 4B, New York, NY (US) 10033

( * ) Notice: Subject to any disclaimer, the term of this patent is extended or adjusted under 35 U.S.C. 154(b) by 0 days.

(21) Appl. No.: 10/624,142

(22) Filed: Jul. 21, 2003

(51) Int. Cl.[7] ..... E06B 7/02
(52) U.S. Cl. ..... 454/196; 248/200.1
(58) Field of Search ..... 454/196, 254; 248/200.1, 125.8, 411, 413

(56) References Cited

U.S. PATENT DOCUMENTS 3,847,246 A * 11/1974 Banner ..... 182/78
4,634,339 A * 1/1987 Keddy ..... 415/70
5,167,131 A * 12/1992 Karkhanis ..... 62/262
5,582,025 A * 12/1996 Dubin et al. ..... 62/262
5,636,816 A * 6/1997 Burton et al. ..... 248/208

* cited by examiner

*Primary Examiner*—Derek S. Boles
(74) *Attorney, Agent, or Firm*—Edward P. Dutkiewicz

(57) ABSTRACT

A support bas assembly has a first bar and a second bar. Each bar has a outdoor face, a parallel indoor face, a horizontal planar upper face, a parallel lower face, a free end and a central end. The central end of the second bar is slidably received within the central end of the first bar. Secured to the outdoor face of the first bar adjacent to the central end is a locking assembly.

5 Claims, 4 Drawing Sheets

FIG 3
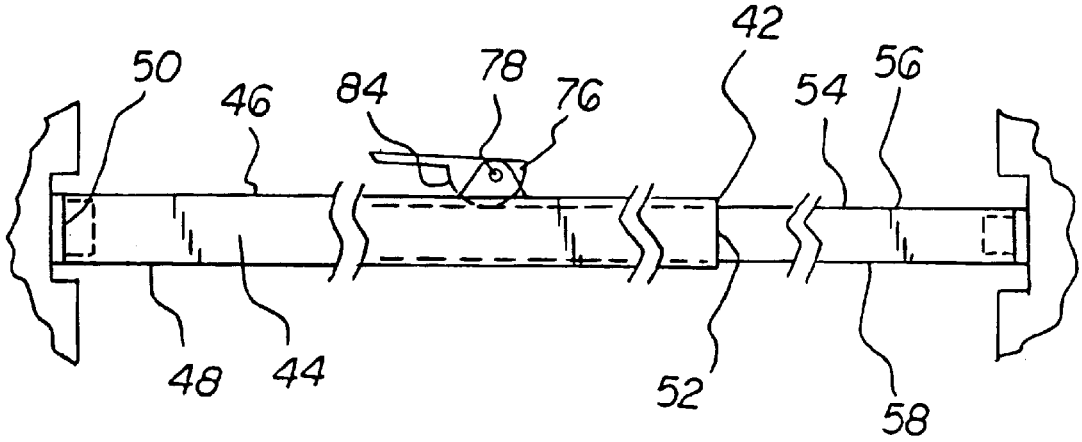
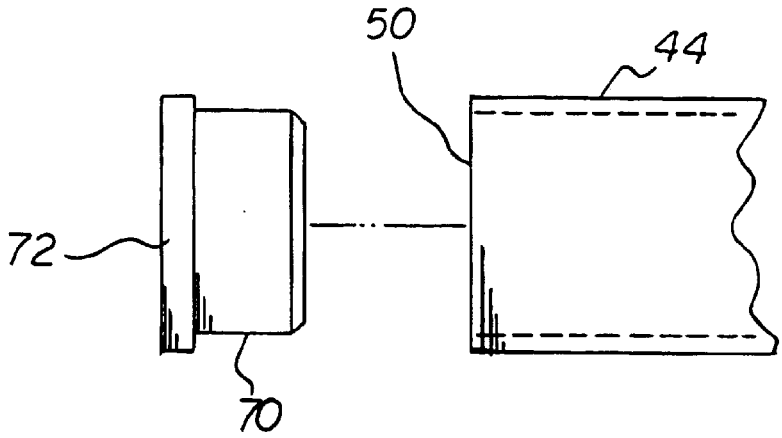
FIG 4

FIG 6
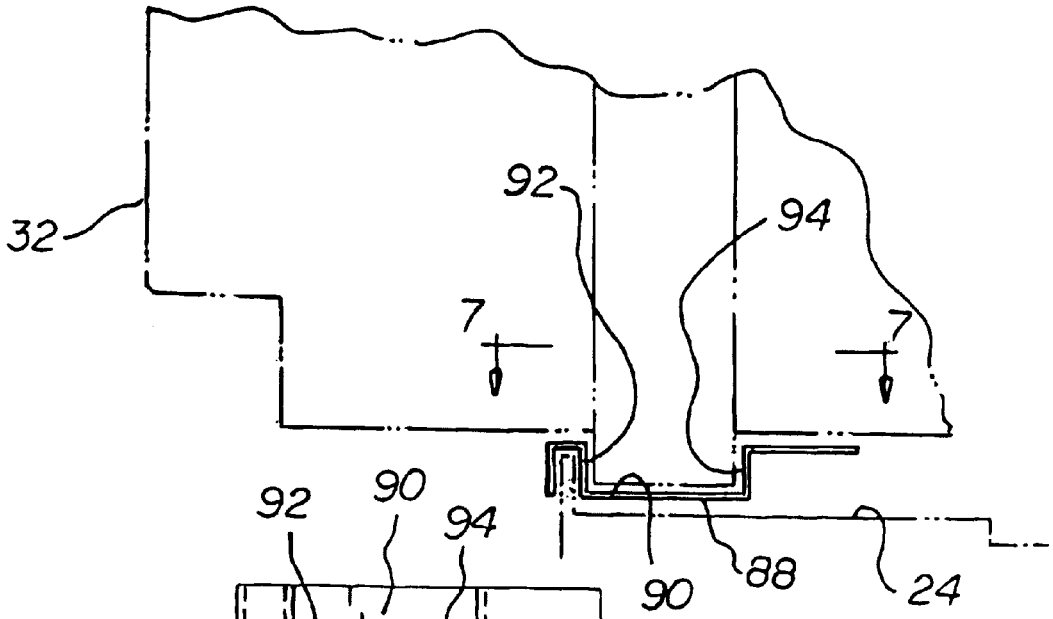
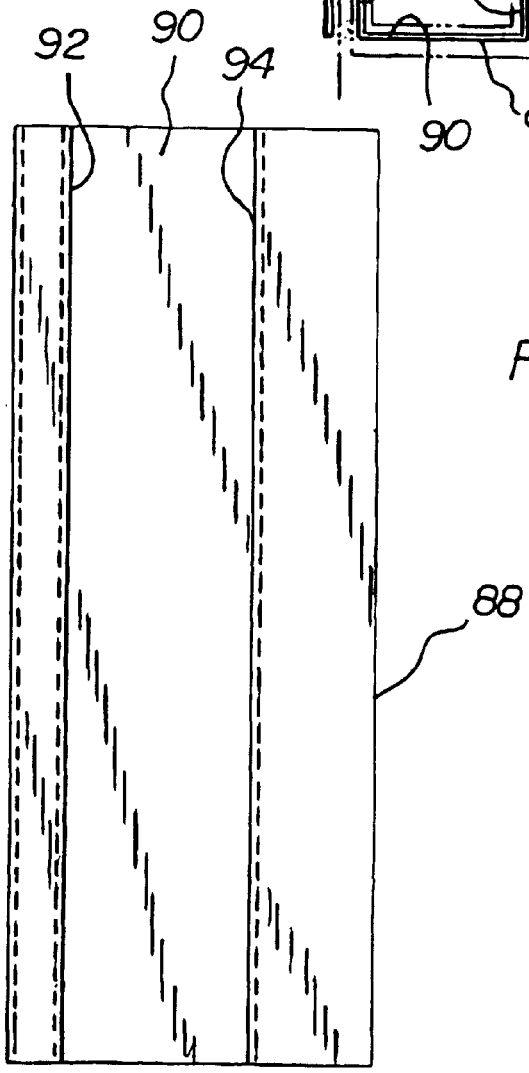
FIG 7

WINDOW-MOUNTED AIR CONDITIONER INSTALLATION SYSTEM

BACKGROUND OF THE INVENTION

1. Field of the Invention

The present invention relates to a window-mounted air conditioner installation system and more particularly pertains to securing an air conditioner in a window opening while allowing a user to open and close the window in a safe and convenient manner.

2. Description of the Prior Art

The use of window-mounted air conditioner installation systems of known designs and configurations is known in the prior art. More specifically, window-mounted air conditioner installation systems of known designs and configurations previously devised and utilized for the purpose of securing an air conditioner in a window opening are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,134,319 issued May 26, 1964, to Marsteller discloses an air conditioning apparatus. U.S. Pat. No. 3,476,033 issued Nov. 4, 1969, to Appel discloses a room air-conditioner improved mounting arrangement. U.S. Pat. No. 3,911,803 issued Oct. 14, 1975 to Kong et al discloses a mounting arrangement for room air conditioner. Finally, U.S. Pat. No. Des. 380,533 issued Jul. 1, 1997, to Molnar discloses an integrated compact air conditioner.

While these devices fulfill their respective, particular objectives and requirements, the aforementioned patents do not describe a window-mounted air conditioner installation system that allows securing an air conditioner in a window opening while allowing a user to open and close the window in a safe and convenient manner.

In this respect, the window-mounted air conditioner installation system according to the present invention substantially departs from the conventional concepts and designs of the prior art, and in doing so provides an apparatus primarily developed for the purpose of securing an air conditioner in a window opening while allowing a user to open and close the window in a safe and convenient manner.

Therefore, it can be appreciated that there exists a continuing need for a new and improved window-mounted air conditioner installation system which can be used for securing an air conditioner in a window opening while allowing a user to open and close the window in a safe and convenient manner. In this regard, the present invention, as disclosed in the specification and drawings herein, substantially fulfills this and various needs.

SUMMARY OF THE INVENTION

In view of the foregoing disadvantages inherent in the known types of window-mounted air conditioner installation systems of known designs and configurations now present in the prior art, the present invention provides an improved window-mounted air conditioner installation system. As such, the general purpose of the present invention, which will be described subsequently in greater detail, is to provide a new and improved window-mounted air conditioner installation system and method which has all the advantages of the prior art and none of the disadvantages.

To attain this, the present invention essentially comprises a window assembly. The window assembly includes a vertically reciprocable rectangular window. The window has a peripheral support with a planar lower face and vertical side faces. The window assembly also includes a lower horizontal sash and vertical side supports for slidably receiving the vertical side faces of the window. The lower horizontal sash and vertical side supports define a window opening of a fixed width.

Next, a window mounted air conditioner is provided. The air conditioner is positionable in the window opening with a lower surface positionable upon the sash with a base plate in between and with an exposed planar upper horizontal surface. The air conditioner has side plates laterally adjustable to allow a user to seal off the those portions of the window opening laterally spaced from the air conditioner.

A support bar assembly is next provided. The support bar assembly includes a first bar having a length greater than 50 percent, and less than 100 percent, of the width of the window opening. The first bar also has a vertical outdoor face and a parallel indoor face and has a horizontal planar upper face and a parallel lower face. The first bar is hollow with a large rectangular configuration. The first bar has a free end and a central end. The support bar assembly also has a second bar. The second bar has a length greater than 50 percent, and less than 100 percent, of the width of the window opening. The second bar has a vertical outdoor face and a parallel indoor face and has a horizontal planar upper face and a parallel lower face. The first bar is hollow with a small rectangular configuration. The second bar has a free end and a central end. The central end of the second bar is slidably received within the central end of the first bar to allow a user to vary the length of the bar assembly. The bars are fabricated of an essentially rigid material, as for example, an extruded metal such as steel or aluminum.

End stoppers are next provided. The end stoppers have rectilinear portions received within the free ends of the first bar and second bar respectively. Each stopper has an enlarged portion formed integrally with its associated rectilinear portion and positionable against the side faces of the window support. The end stoppers are fabricated of an elastomeric material, plastic or rubber, natural or synthetic or blends thereof.

Next, a locking assembly is provided. The locking assembly is secured to the outdoor face of the first bar adjacent to the central end. The locking assembly includes a vertically disposed pivot pin fixedly spaced from the first bar and a rotatable member supported by the pivot pin. The rotatable member has a handle and a working surface in an arcuate configuration. In this manner, when the handle is moved to a position generally perpendicular to the bar assembly, the interior bar can move with respect to the exterior bar and, when the handle is moved to a position approaching parallelism with the bar assembly, the working surface will frictionally engage the second bar to preclude motion thereof with respect to the first bar.

Lastly, further included is a base plate positionable upon a sash, the base plate having a central section adapted to receive an air conditioner there upon, the base plate also having an indoor section in an inverted U-shaped configuration and an outdoor section in an inverted L-shaped configuration, the outdoor and indoor sections providing bearing surfaces for vertical regions of an air conditioner.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window-mounted air conditioner installation system which has all of the advantages of the prior art window-mounted air conditioner installation systems of known designs and configurations and none of the disadvantages.

It is another object of the invention to allow a user to safely and conveniently take apart a window for purposes of repairing and/or cleaning while a window air conditioner remains in place.

It is another object of the present invention to provide a new and improved window-mounted air conditioner installation system which may be easily and efficiently manufactured and marketed.

It is further an object of the present invention to provide a new and improved window-mounted air conditioner installation system which is of durable and reliable constructions.

An even further object of the present invention is to provide a new and improved window-mounted air conditioner installation system which is susceptible of a low cost of manufacture with regard to both materials and labor, and which accordingly is then susceptible of low prices of sale to the consuming public, thereby making such window-mounted air conditioner installation system economically available to the buying public.

Even still another object of the present invention is to provide a window-mounted air conditioner installation system for securing an air conditioner in a window opening while allowing a user to open and close the window in a safe and convenient manner.

Lastly,it is an object of the present invention to provide a new and improved window-mounted air conditioner installation system with a support bar assembly having a first bar and a second bar each with central and free ends with the central end of the second bar slidably received within the central end of the first bar and a locking assembly secured to the outdoor face of the first bar adjacent to the central end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top elevational view of the support bar assembly taken along line 3—3 of FIG. 2.

FIG. 4 is an exploded front elevational view of the end of the support bar assembly shown in the prior Figures.

FIG. 6 is a side elevational view of the base plate positioned between the sash and the air conditioner.

FIG. 7 is a plan view of the base plate shown in FIGS. 1 and 6.

The same reference numerals refer to the same parts throughout the various Figures.

DESCRIPTION OF THE PREFERRED EMBODIMENT

Figure 1:
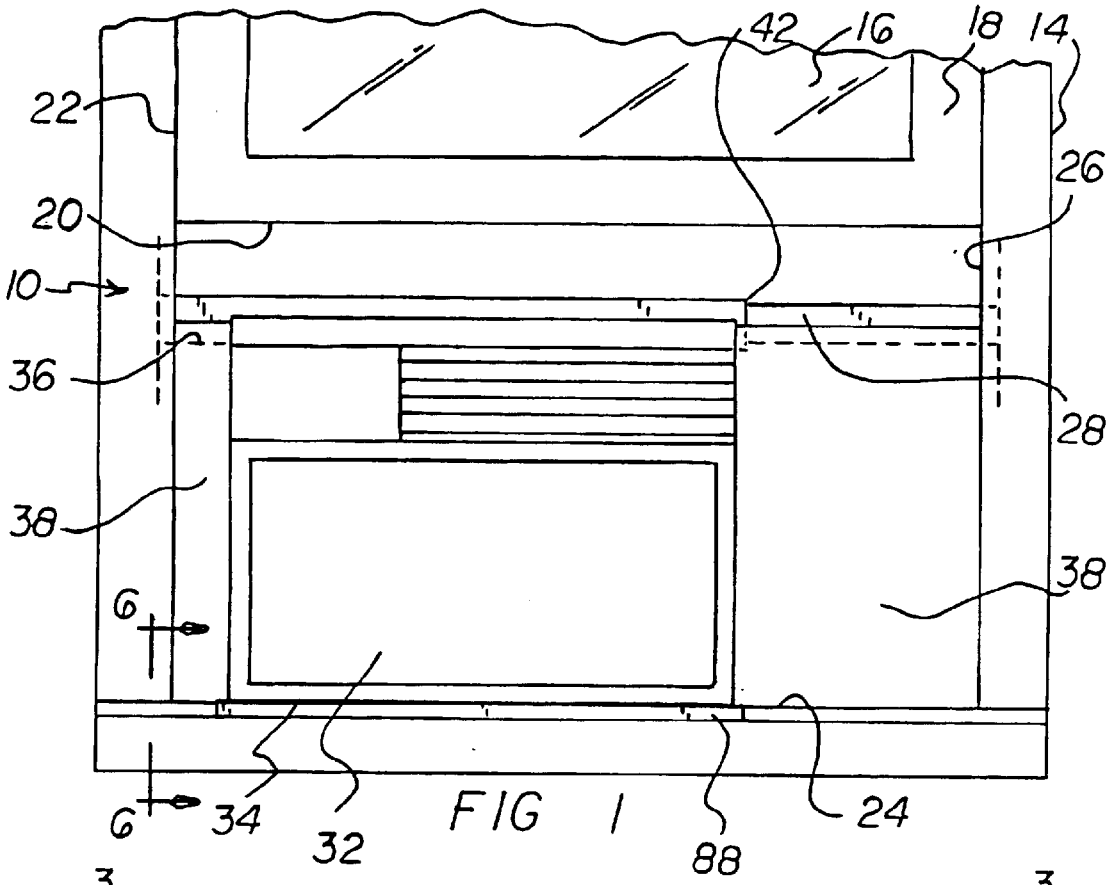
FIG. 1 is a front elevational view of the window mounted, air conditioner installation system constructed in accordance with the principles of the present invention when viewed from the indoor.
Figure 2:
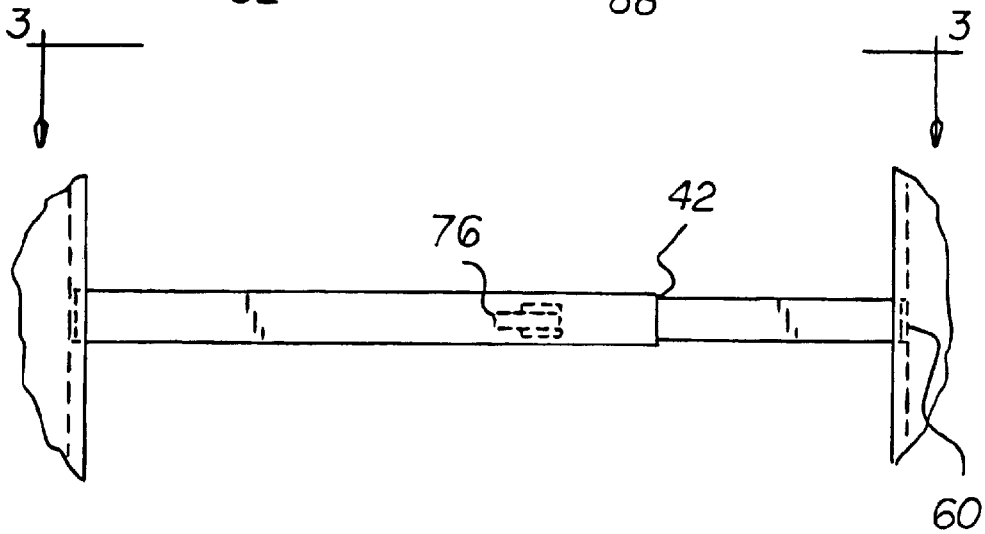
FIG. 2 is an enlarged elevational view of the support bar assembly shown in FIG. 1.
Figure 5:
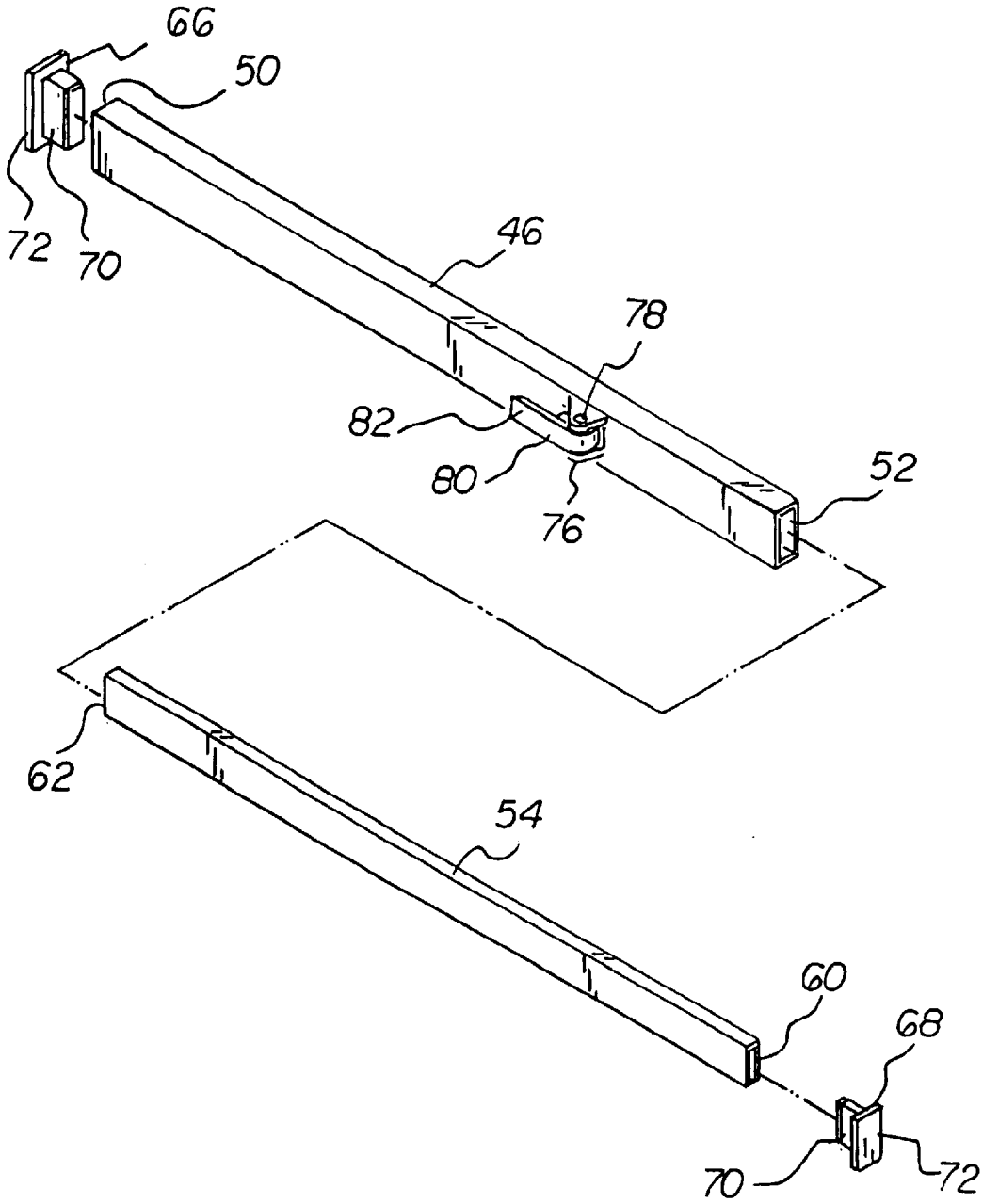
FIG. 5 is an exploded perspective illustration of the support bar assembly of the prior Figures when viewed from outdoors.

With reference now to the drawings, and in particular to FIG. 1 thereof, the preferred embodiment of the new and improved window-mounted air conditioner installation system embodying the principles and concepts of the present invention and generally designated by the reference numeral 10 will be described.

The present invention, the window-mounted air conditioner installation system 10 is comprised of a plurality of components. Such components in their broadest context include a support bar assembly and a locking assembly. Such components are individually configured and correlated with respect to each other so as to attain the desired objective.

First provided is a window assembly 14. The window assembly includes a vertically reciprocable rectangular window 16. The window has a peripheral support 18 with a planar lower face 20 and vertical side faces 22. The window assembly also includes a lower horizontal sash 24 and vertical side supports 26 for slidably receiving the vertical side faces of the window. The lower horizontal sash and vertical side supports define a window opening 28 of a fixed width.

Next, a window mounted air conditioner 32 is provided. The air conditioner is positionable in the window opening with a lower surface 34 positionable upon the sash with a base plate 88 in between and with an exposed planar upper horizontal surface 36. The air conditioner has side plates 38 laterally adjustable to allow a user to seal off the those portions of the window opening laterally spaced from the air conditioner.

A support bar assembly 42 is next provided. The support bar assembly includes a first bar 44 having a length greater than 50 percent, and less than 100 percent, of the width of the window opening. The first bar also has a vertical outdoor face 46 and a parallel indoor face 48 and has a horizontal planar upper face and a parallel lower face. The first bar is hollow with a large rectangular configuration. The first bar has a free end 50 and a central end 52. The support bar assembly also has a second bar 54. The second bar has a length greater than 50 percent, and less than 100 percent, of the width of the window opening. The second bar has a vertical outdoor face 56 and a parallel indoor face 58 and has a horizontal planar upper face and a parallel lower face. The first bar is hollow with a small rectangular configuration. The second bar has a free end 60 and a central end 62. The central end of the second bar is slidably received within the central end of the first bar to allow a user to vary the length of the bar assembly. The bars are fabricated of an essentially rigid material, as for example, an extruded metal such as steel or aluminum.

End stoppers 66, 68 are next provided. The end stoppers have rectilinear portions 70 received within the free ends of the first bar and second bar respectively. Each stopper has an enlarged portion 72 formed integrally with its associated rectilinear portion and positionable against the side faces of the window support. The end stoppers are fabricated of an elastomeric material, plastic or rubber, natural or synthetic or blends thereof.

Next, a locking assembly 76 is provided. The locking assembly is secured to the outdoor face of the first bar adjacent to the central end. The locking assembly includes a vertically disposed pivot pin 78 fixedly spaced from the first bar and a rotatable member 80 supported by the pivot pin. The rotatable member has a handle 82 and a working surface 84 in an arcuate configuration. In this manner, when the handle is moved to a position generally perpendicular to the bar assembly, the interior bar can move with respect to the exterior bar and, when the handle is moved to a position approaching parallelism with the bar assembly, the working surface will frictionally engage the second bar to preclude motion thereof with respect to the first bar.

The next component of the system is a base plate 88. The base plate is positionable upon a sash 24 of a window opening in which the system is to be employed. The base plate has a central section 90 which is adapted to receive an air conditioner 32 there upon. The base plate also has an indoor section 92 in an inverted U-shaped configuration and an outdoor section 94 in an inverted L-shaped configuration. The outdoor and indoor sections provide bearing surfaces for vertical regions of an air conditioner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window-mounted air conditioner installation system for securing an air conditioner in a window opening while allowing a user to open and close the window in a safe and convenient manner comprising, in combination:

a window assembly including a vertically reciprocable rectangular window with a peripheral support with a planar lower face and vertical side faces, the window assembly also including a lower horizontal sash and vertical side supports for slidably receiving the vertical side faces of the window, the lower horizontal sash and vertical side supports defining a window opening of a fixed width;

a window mounted air conditioner positionable in the window opening with a lower surface positionable upon the sash with a base plate in between and with an exposed planar upper horizontal surface, the air conditioner having side plates laterally adjustable to allow a user to seal off the those portions of the window opening laterally spaced from the air conditioner;

a support bar assembly including a first bar having a length greater than 50 percent, and less than 100 percent, of the width of the window opening and having a vertical outdoor face and a parallel indoor face and having a horizontal planar upper face and a parallel lower face, the first bar being hollow with a large rectangular configuration, the first bar having a free end and a central end, the support bar assembly also having a second bar having a length greater than 50 percent, and less than 100 percent, of the width of the window opening and having a vertical outdoor face and a parallel indoor face and having a horizontal planar upper face and a parallel lower face, the first bar being hollow with a small rectangular configuration, the second bar having a free end and a central end, the central end of the second bar being slidably received within the central end of the first bar to allow a user to vary the length of the bar assembly, the bars being fabricated of an essentially rigid material;

end stoppers having rectilinear portions received within the free ends of the first bar and second bar respectively, each stopper having an enlarged portion formed integrally with its associated rectilinear portion and positionable against the side faces of the window support, the end stoppers being fabricated of an elastomeric material;

a locking assembly secured to the outdoor face of the first bar adjacent to the central end, the locking assembly including a vertically disposed pivot pin fixedly spaced from the first bar and a rotatable member supported by the pivot pin, the rotatable member having a handle and a working surface in an arcuate configuration whereby when the handle is moved to a position generally perpendicular to the bar assembly the interior bar can move with respect to the exterior bar and when the handle is moved to a position approaching parallelism with the bar assembly, the working surface will frictionally engage the second bar to preclude motion thereof with respect to the first bar; and a base plate positionable upon a sash, the base plate having a central section adapted to receive an air conditioner there upon, the base plate also having an indoor section in an inverted U-shaped configuration and an outdoor section in an inverted L-shaped configuration, the outdoor and indoor sections providing bearing surfaces for vertical regions of an air conditioner.

2. A window-mounted air conditioner installation system comprising:

a support bar assembly including a first bar and a second bar, each bar having a vertical outdoor face and a parallel indoor face and having a horizontal planar upper face and a parallel lower face, each bar having a free end and a central end, the central end of the second bar being slidably received within the central end of the first bar; and a locking assembly secured to the outdoor face of the first bar adjacent to the central end.

3. The system as set forth in claim 2 wherein the locking assembly including a vertically disposed pivot pin fixedly spaced from the first bar and a rotatable member supported by the pivot pin, the rotatable member having a handle and a working surface in an arcuate configuration whereby when the handle is moved to a position generally perpendicular to the bar assembly the interior bar can move with respect to the exterior bar and when the handle is moved to a position approaching parallelism with the bar assembly, the working surface with frictionally engage the second bar to preclude motion thereof with respect to the first bar.

4. The system as set forth in claim 2 and further including end stoppers having rectilinear portions received within the free ends of the first bar and second bar respectively, each stopper having an enlarged portion formed integrally with its associated rectilinear portion.

5. The system as set forth in claim 2 and further including a base plate positionable upon a sash, the base plate having a central section adapted to receive an air conditioner there upon, the base plate also having an indoor section in an inverted U-shaped configuration and an outdoor section in an inverted L-shaped configuration, the outdoor and indoor sections providing bearing surfaces for vertical regions of an air conditioner.

* * * * *